US005226978A

United States Patent [19]

Hunt et al.

[11] Patent Number: 5,226,978

[45] Date of Patent: Jul. 13, 1993

[54] STEEL TUBE ALLOY

[75] Inventors: Patrick J. Hunt, Sault Ste. Marie; John J. Jonas, Westmount; Stephen Yue, Montreal; George E. Ruddle, Ottawa, all of Canada

[73] Assignee: The Algoma Steel Corporation, Limited, Sault Ste. Marie, Canada

[21] Appl. No.: 751,071

[22] Filed: Aug. 28, 1991

Related U.S. Application Data

[63] Continuation-in-part of Ser. No. 568,673, Aug. 16, 1990, abandoned.

[51] Int. Cl.[5] ..... C22C 38/12; C22C 38/04

[52] U.S. Cl. ..... 148/328; 148/909

[58] Field of Search ..... 148/328, 909; 420/126, 420/127

[56] References Cited

U.S. PATENT DOCUMENTS 3,773,500 11/1973 Kanazawa et al. ..... 420/126

FOREIGN PATENT DOCUMENTS 2-163319 6/1990 Japan ..... 148/12 B

OTHER PUBLICATIONS

"Laboratory Simulation of Seamless Tube Piercing and Rolling Using Dynamic Recrystallization Schedules", Pussegoda et al, Metallurgical Transactions A., Jan. 1990, vol. 21A, pp. 153-164.

"Recrystallization Controlled Rolling of Seamless Tubing" Barbosa et al, 1986.

*Primary Examiner*—Deborah Yee

*Attorney, Agent, or Firm*—Robert H. Barrigar; John Q. McQuillan

[57] ABSTRACT

Seamless steel tubes suitable for use as grades of casing and line pipe having yield strengths in excess of 70,000 psi, without being heat treated, are made of an alloy comprising, by weight, about 0.10% to 0.18% carbon, about 1.0% to 2.0% manganese, about 0.10% to 0.16% vanadium, about 0.008% to 0.012% titanium and about 150 parts per million to 220 parts per million nitrogen, the balance comprising iron and incidental impurities. Strains are applied to the shell in a stretch reducing mill below the $T_{nr}$ of the steel and above the $A_{r3}$ to provoke dynamic recrystallization. The nitrogen and vanadium are preferably introduced to the steel during alloying in the form of a VN alloying agent. The vanadium, titanium and nitrogen are predominantly present as vanadium nitride and titanium nitride. The steel may also comprise 0.03% to 0.05% aluminum by weight.

12 Claims, 8 Drawing Sheets

2 1/4 X 500 0.1% C 0.1% V G.D.N. 14.2
ACCELERATED COOLING

61/4 X 500 0.1% C 0.16% V G.D.N. 15.5
ACCELERATED COOLING 10 1/4 X 500 0.18% C 0.1% V G.D.N. 13.0
ACCELERATED COOLING 14 1/4 X 500 0.18% C 0.16% V G.D.N. 15.5
ACCELERATED COOLING

STEEL TUBE ALLOY

RELATED APPLICATIONS

The application is a continuation-in-part of U.S. patent application Ser. No. 07/568,673 filed 16 Aug., 1990, now abandoned.

This application is a companion to application Ser. No. 07/751,078, filed concurrently herewith.

FIELD OF THE INVENTION

The present invention relates to seamless steel tubing made from an improved high strength low alloy steel, and to such steel alloy for use in making such tubing. The companion application relates to a method of manufacturing seamless steel tube involving the use of recrystallization controlled rolling of a micro-alloyed steel having improved yield and fracture strength.

BACKGROUND OF THE INVENTION

The process of seamless steel tube making is essentially a high temperature hot rolling operation. Conventional seamless tube manufacture comprises the steps of reheating a billet of steel having the desired chemical composition in a reheating furnace to a temperature of about 1,200° to 1,300° C., passing the said billet through a piercing mill wherein the billet is formed into a hollow steel shell, elongating the steel shell in a retained mandrel mill wherein the thickness of the shell wall is reduced, and then reducing the diameter of the elongated shell by stretching the shell in a stretch reducing mill. The resulting steel tubes can then be heat treated to increase the final strength of the finished product. This final heat treating stage, although fairly expensive, has heretofore been required in order to obtain a final product with yield strengths in excess of 70,000 psi.

It is known to be possible to increase the final strength of steel structures by controlled rolling and micro-alloying. See, for example, Canadian Patent No. 1,280,015, Boratto et al., 12 Feb., 1991. Micro-alloyed steels are generally low carbon steels containing columbium and/or titanium at levels totalling approximately 0.05% by weight of the steel or vanadium at levels of about 0.1%. In controlled rolling, an ingot or slab of micro-alloyed steel is first heated to a temperature of about 1,250° C. and then subjected to a rolling schedule involving delays in the pass sequence such that substantial strain is applied to the slab or ingot below a temperature of 950° C. The strain applied in conventional controlled rolling (CCR) causes pancaking of the austenite crystals which, in turn, yields a fine ferrite grain structure upon cooling due to the presence of the distorted austenite grain structure and of ferrite growth retarding alloying agents such as columbium or titanium.

In seamless tube production, however, 70% to 90% of the strain is applied to the billet at a temperature above 1,040° C., which temperature is well above the "no-recrystallization" temperature $T_{nr}$ for static recrystallization of the steel used (The temperature $T_{nr}$ is dependent not only upon alloy composition but also upon the rolling schedule. See e.g. Tanaka et al., "Three Stages of the Controlled Rolling Process", Microalloying '75, Union Carbide, 1975, p.107, and also the above mentioned Boratto Canadian Patent Mo. 1,280,015, where the symbol $T_n$ is used instead of $T_{nr}$.) Moreover, once the steel has cooled below the $T_{nr}$ and is processed in the stretch reducing mill, there is insufficient time between passes for sufficient carbonitride to occur, which is a requirement for pancaking of the austenite. As a result, conventional controlled rolling cannot appreciably increase the yield strength of seamless tubes because no significant austenite pancaking can occur at the desired temperatures.

There are a number of known methods for increasing the yield strength of seamless steel tubes, including recrystallization controlled rolling (RCR), which also produces ferrite grain refinement: See, R. Barbosa, S. Yue, J. J. Jonas and P. J. Hunt, "Recrystallization Controlled Rolling of Seamless Tubing"; Proc. International Conference on Phys. Metall. of Thermomechanical Processing of Steels and Other Metals (Thermec-88), Tokyo, Japan, June 1988, pp. 535-542. In conventional recrystallization controlled rolling, reductions are effected above the $T_{nr}$, and the austenite grain size is reduced by static recrystallization after the application of strain. Grain growth of the recrystallized austenite is inhibited by the use of alloying in additions, particularly titanium. Upon cooling, the austenite transforms into ferrite having a fine grain structure and increased yield strength. The yield strength of steel tubes may also be increased by solid solution strengthening and by increasing the volume fraction of the carbon-containing phase, pearlite. Classical alloying additives which increase solid solution strengthening include molybdenum and manganese, whereas an increase in carbon content leads to an increase in pearlite volume fraction.

A further component of strengthening is contributed by precipitation hardening, as caused for example by the formation of fine precipitates of vanadium nitride.

The yield strength of finished seamless steel tubes may also be increased by accelerated cooling of the steel tubes during the austenite-to-ferrite transformation, which imparts a further grain refining effect. Posdena et al in a paper entitled "Application of Microalloyed Steels to The Production of Seamless Line Pipe and OCTG"; Proc. Conference on 'HSLA Steels '85', Beijing, China, November 1985, pp. 493-506, discloses the manufacture of seamless steel tubes, made from microalloyed steels having moderate carbon concentrations (e.g. 0.08%) and microalloying additions such as titanium, vanadium and niobium, which are subjected to accelerated cooling following the stretch reducing mill. However, the steels produced by the above prior art methods are still not strong enough to be used for grades of casing or line pipe requiring yield strength in excess of 70,000 psi, without subsequent quenching and tempering.

SUMMARY OF THE INVENTION

The steel alloy of the present invention comprises, by weight, about 0.10% to 0.18% carbon, about 1.0% to 2.0% manganese, about 0.10% to 0.16% vanadium, about 0.008% to 0.012% titanium and about 150 p.p.m. to 220 p.p.m. nitrogen, the balance comprising iron and incidental impurities.

Such alloy ca be used according to the invention to make rolled seamless steel tubes suitable for use as various higher grades of line pipe and casing having yield strengths which heretofore could be achieved only by subsequent heat treatment. The technique involves the use of static and dynamic recrystallization controlled rolling of an alloy steel of a preselected alloy composition. The technique may be practised in combination with cooling below the $A_{r1}$ temperature prior to reheating and finish rolling and/or accelerated cooling after finish rolling. The invention thus makes possible an improvement in the manufacturing of a high-strength seamless steel tube from a billet by passing a hot billet of steel shell; elongating the steel shell within a mandrel mill located downstream of the piercing mill; and reducing the diameter of the elongated shell by a series of reductions in a stretch reducing mill located downstream of the mandrel mill to form a tube of desired diameter.

In the stretch reducing mill, strains are applied to the shell while the temperature of the steel is maintained above the $A_{r3}$ temperature but below the $T_{nr}$ temperature, thereby causing accumulated strain in the stretch-reduced tube.

As a consequence, the yield strength of the tube is enhanced by (i) dynamic recrystallization in the absence of strain-induced precipitation, (ii) grain refinement of austenite (due in large measure to the presence of titanium and working of the steel above the $T_{nr}$) that is transformed upon further cooling to retained grain refinement of ferrite in the shell; and (iii) precipitation strengthening by precipitation of vanadium nitride. (Note that the precipitation strengthening occurs only during the ferrite phase—precipitation during the austenite phase is to be avoided).

Depending upon the exit temperature of the steel shell from the retained mandrel mill, the steel may have to be reheated before it enters the stretch reducing mill. The entry temperature should be high enough that all of the planned reduction in the stretch reducing mill can occur above the $A_{r3}$ temperature.

Because in the stretch reducing mill only a very short time typically elapses between successive reduction, there is insufficient time for static recrystallization or strain-induced precipitation to occur, and consequently no special precautions need to be taken. (If long delays between passes were expected, niobium would be preferred to titanium as an alloying element, and dynamic recrystallization in such case would not occur).

Optimally the tube exits the stretch reducing mill at a temperature slightly above (say about 20° C. above) the $A_{r3}$ temperature. Further reductions at lower temperature will tend to produce conventional pancaking, which is unhelpful to the dynamic recrystallization controlled rolling technique.

Accelerated cooling may follow the exit of the tube from the stretch reducing mill, at a cooling rate of about 3° C./s to 5° C./s.

In one embodiment of the present invention, a billet of steel consisting essentially of, by weight, about 0.10% to 0.18% vanadium, about 0.008% to 0.012% titanium and nitrogen in excess of about 150 parts per million, the balance comprising iron and incidental impurities, is reheated in a reheating furnace to a temperature in the range of about 1,200° C. to about 1,300° C. The billet of microalloyed steel is then passed through a piercing mill wherein the billet is formed into a steel shell. The steel shell then travels downstream to a retained mandrel mill wherein the thickness of the wall of the steel shell is reduced. The shell is then heated in an in-line re-heating furnace, and passed to a stretch reducing mill located downstream of the mandrel mill, wherein the diameter of the shell is reduced to the desired diameter.

The steel shell may if desired be subjected to in-line normalizing, i.e. it may be cooled below its $A_{r1}$ temperature prior to its entry into the stretch reducing mill, and thereafter reheated prior to commencing the stretch reduction. In the stretch reducing mill, sufficient strain is applied to the shell to provoke dynamic recrystallization and to bring about grain refinement of the austenite, and subsequently of the ferrite. The steel tube may preferably be force cooled upon exiting the stretch reducing mill at a preselected rate. The rate of force cooling of the stretch reduced tube may vary between about 3° C. per second to about 5° C. per second. The rate of forced cooling is selected such that the steel tube is cooled uniformly throughout the thickness of its wall to a temperature of approximately 600° C. and then air cooled to room temperature.

Steel tubes produced in accordance with the present invention have yield strengths of between 70,000 psi to about 110,000 psi. Therefore, line pipe of rating X-60 to X-90 as well as casing and tubing of ratings N-80, C-90, C-95 and P-105 can be produced by the method of the invention without the need for expensive heat treatment of the finished steel tubes.

Steel made according to the invention has an essentially uniform fine ferritic grain structure with an average grain size of less than 10 micrometers. The steel may also contain between 0.03% to 0.05% aluminum by weight and the chemistry may also be adjusted to permit the continuous casting of the steel.

The described manufacturing process works best when the diameter of the finished tube as it exits the stretch reducing mill is appreciably smaller than the diameter of the shell as it enters the stretch reducing mill. If the exit diameter is close to the entry diameter, i.e. if the required reduction is small and there are few passes, there will be insufficient accumulated strain to permit much dynamic recrystallization to occur, which will reduce the achievable benefit from the practice of the present invention as compared to conventional practice. In such cases, reduction above the $T_{nr}$, temperature may be preferred.

DETAILED DESCRIPTION

First, steel having the desired alloy composition (chemistry) is made. This steel, as mentioned previously, comprises by weight, about 0.10% to 0.18% carbon, about 1.0% to 2.0% manganese, about 0.10% to 0.16% vanadium, about 0.008% to 0.012% titanium and about 150 p.p.m. to 220 p.p.m. nitrogen, the balance comprising iron and incidental impurities.

Figure 1:
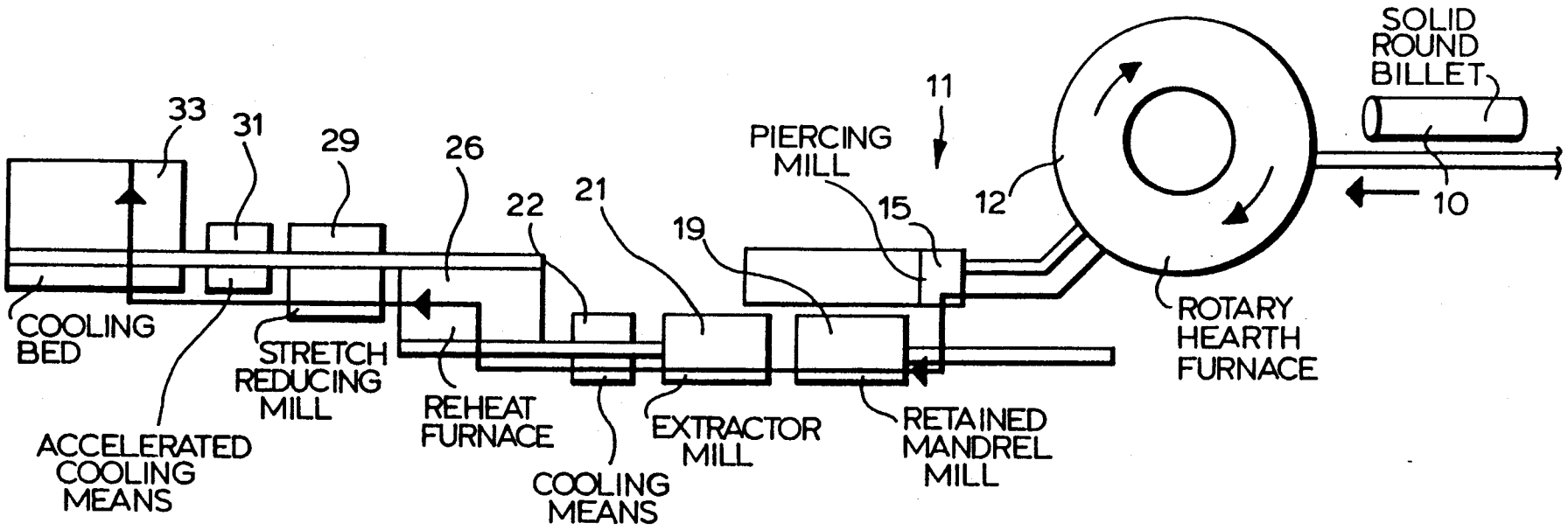
FIG. 1 illustrates a schematic representation of a seamless tube mill utilizing the method of the invention of companion application Ser. No. 07/751,078.

With primary reference to FIG. 1, this high-strength steel is formed into steel billet 10. Steel billet 10 is then passed through a tube rolling mill shown generally as 11. Tube rolling mill 11 comprises a rotary hearth furnace 12, a piercing mill 15, a retained mandrel mill 19, an extractor mill 21, optional cooling means 22, reheating furnace 26, stretch reducing mill 29, optional accelerated cooling means 31, and cooling bed 33. These mills are continuous with one another; i.e. there is no interruption of flow of steel product through the mills.

The nitrogen content of the steel is selected to ensure that most of the vanadium and titanium present in the steel is in the form of vanadium nitride and titanium nitride. In the preferred embodiment of the present invention, this is achieved by adding the nitrogen to the molten metal in the form of an alloying additive containing 80% vanadium and 12% nitrogen by weight. The alloy may also contain between 0.03% to 0.05% aluminum by weight. The aluminum acts as a deoxidizing agent and improves the surface qualities of the finished products.

The steel may be formed into billets in a conventional billet mill. Alternatively, due to the chemistry of the alloy, the steel may be continuously cast by continuous strand casting. Steel billet 10 is then reheated in reheating furnace 12 to a temperature of between about 1,200° C. to 1,300° C. Steel billet 10 then passes into piercing mill 15 located downstream of the reheating furnace. Within piercing mill 15, a piercer and rolls transform billet 10 into a hollow steel shell. Steel shell then enters retained mandrel mill 19 located immediately downstream of piercing mill 15. Within retained mandrel mill 19, a mandrel is inserted into the hollow of the shell and the two are rolled together through rolling stands. The thickness of the walls of the steel shell are reduced within mandrel mill 19 to the desired level. Extractor mill 21 serves to extract the mandrel from the shell. The steel shell exits the mandrel mill 19 at a temperature of approximately 1,000° C.

The steel shells may be cooled upon exiting the mandrel mill to a temperature below the $A_{r1}$ transformation temperature within cooling means 22 located downstream of mandrel mill 19. This cooling may also occur by natural cooling, depending on wall thickness. The cooled steel shells are then placed within reheating furnace 26 and reheated to a temperature of approximately between 900° C. and 950° C. The steel shells then enter stretch reducing mill 29 and are transformed within mill 29 into steel tubes having a reduced diameter. Upon exiting stretch reducing mill 29, the steel tubes are passed to a cooling bed 33 located downstream of stretch reducing mill 29 wherein the steel tubes are cooled to room temperature.

Within stretch reducing mill 29, the steel shells are systematically stretched between rollers such that the diameters of the shells are reduced. In stretch reducing mill 29, rolling is carried out below the $T_{nr}$ temperature of the steel. The $T_{nr}$ is arranged to be above the temperature range of stretch reducing mill processing by suitable adjustments of the microalloying additives, especially of the vanadium level in the preferred embodiment. Stretching, carried out at such temperatures, leads to the initiation of dynamic recrystallization and of the dynamic grain refinement process. In dynamic recrystallization controlled rolling, the strain is at first accumulated from pass to pass because of the absence of static recrystallization below the $T_{nr}$. Then dynamic recrystallization is initiated after a critical strain, resulting in austenite grain refinement. Conventional recrystallization controlled rolling is not of course possible in this temperature range. A critical parameter is the time between each deformation pass, i.e. the delay time, in the stretch reducing mill. The delay time between passes in this mill is typically 0.2s. Such short times prevent static recrystallization from occurring between passes, thus enabling the strain accumulation required for the present process to take place. These short times are also insufficient for appreciable precipitation to occur, eliminating the conventional austenite pancaking route for ferrite grain refinement.

All of the reduction in the stretch reducing mill should occur above the $A_{r3}$ temperature; otherwise the last reductions would cause pancaking, which does not improve the grain structure obtained by dynamic recrystallization controlled rolling.

The steel tubes may be force cooled within accelerated cooling means 31 located downstream of stretch reducing mill 29. Within cooling means 31, the steel tubes are cooled at a rate of between 3° C. per second to about 5° C. per second. The rate of cooling of the tubes may be precisely controlled in order to promote uniform grain refinement throughout the wall thickness of the tube. A cooling rate is selected which avoids the formation of bainite along the periphery of the tube walls. Depending on the diameter of the tubes, a variety of controlled accelerated cooling means may be employed. Such cooling means may include cooling with fine mists of water, or intermittent spray cooling or forced air. Note that for tubes having relatively thin walls, say up to about 0.4" in thickness, no special cooling may be needed.

Billet 10 enters the seamless tube rolling mill 11 at a temperature of between 1,200° C. to about 1,300° C. Billets 10 cool as they are processed through mill 11 and their temperatures may drop below the $A_{r1}$ temperature after they exit retained mandrel mill 19. Reheating furnace 26 reheats the steel shells to a temperature of approximately 900°-950° C. As the shells pass through stretch reducing mill 29, their temperatures progressively drop until they exit the mill at between 700° C. and 800° C. The finished tubes are then cooled to room temperature on cooling bed 33 at a variety of cooling rates.

Figure 2:
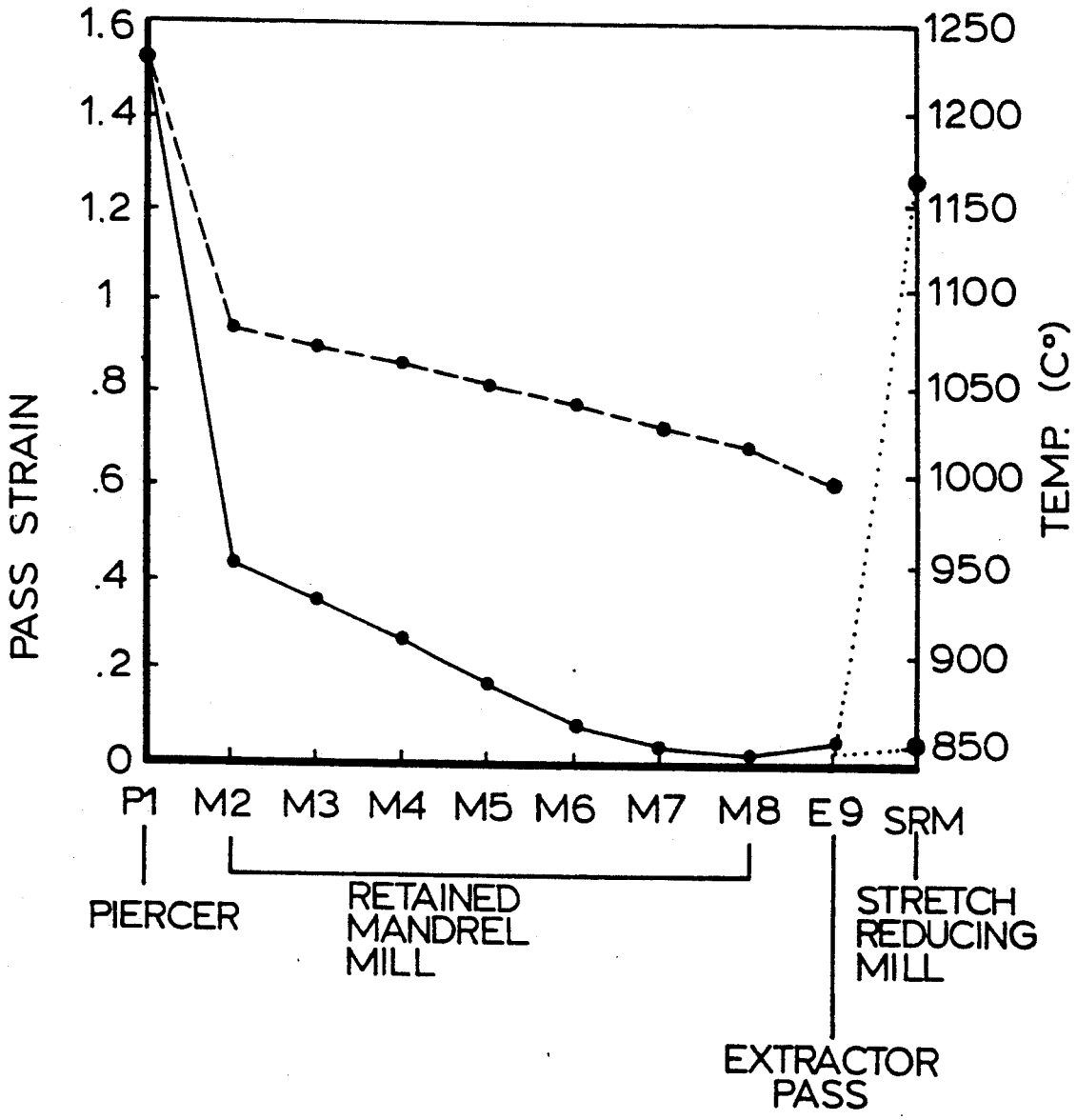
FIG. 2 is a graphical illustration of the temperature-time profile and the strain-time profile of the method of the invention of the companion application Ser. No. 751,078, up to the extractor pass.

Referring now to FIG. 2, the upper broken-line curve is a representative temperature vs. time (pass number) plot, the right-hand ordinate giving temperature values, and the abscissa showing the pass numbers. The lower solid-line curve shows strain vs. time (pass number). The left-hand ordinate gives strain values. It can be seen that between 40% to 50% of the strain is applied to steel billet 10 during its processing occurs during the piercing stages of the method of the present invention. Significant strain is also applied by retained mandrel mill 19 and by stretch reducing mill 29. In all cases, however, the strain is applied to the shell or billet while the shell or billet is at a temperature in excess of 800° C. The application of strain to the shell causes the reduction in the grain size of the shell. In nonmicroalloyed steels, grain growth would occur following the application of strain due to the high temperature of the samples. The presence of titanium nitride within the steel, however, prevents their growth and maintains a fine austenite grain size. As the shell cools, the austenite transforms to ferrite leaving an end product with a highly refined grain structure and a high yield strength. The dropping of the temperature of the steel shell below its $A_{r1}$ temperature also has a grain refining effect.

Figure 5:
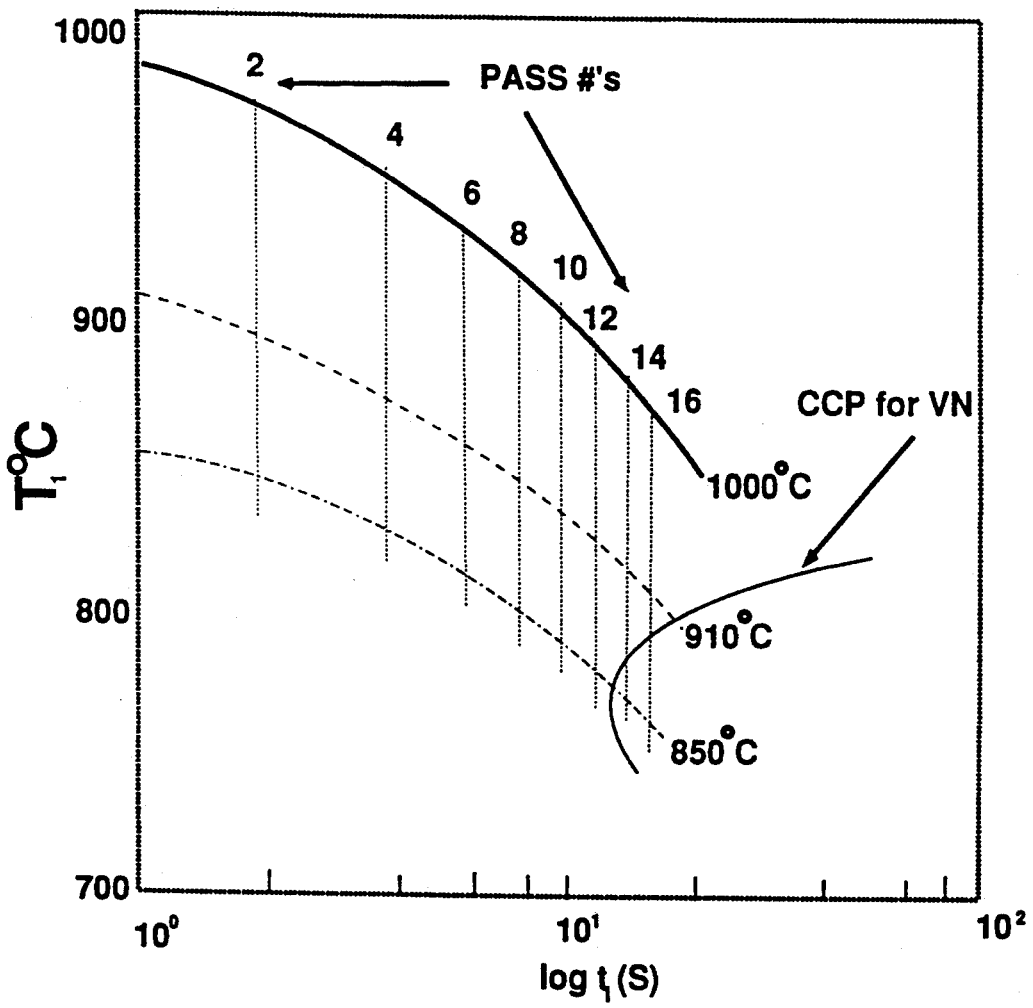
FIG. 5 is a temperature-vs.-time graph illustrating typical temperature declines for representative stretch-reducing tube reduction schedules having different entry temperatures, and the relationship of these to continuous-cooling precipitation conditions
Figure 6C:
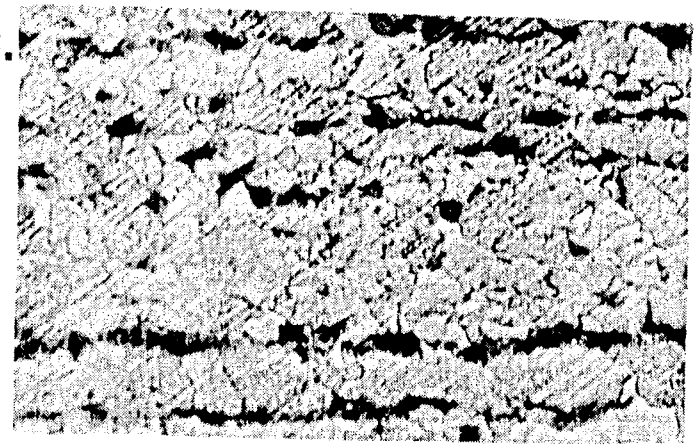
FIGS. 6A through 6H are photomicrographs showing the crystal structure of various steel samples made in accordance with the present invention.
Figure 6A:
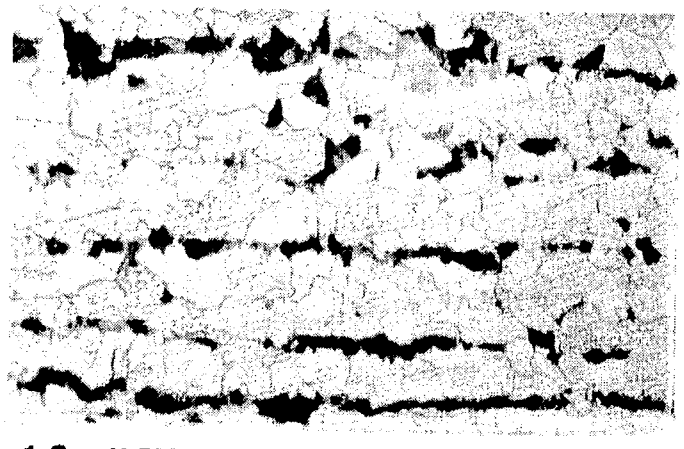
Figure 6G:
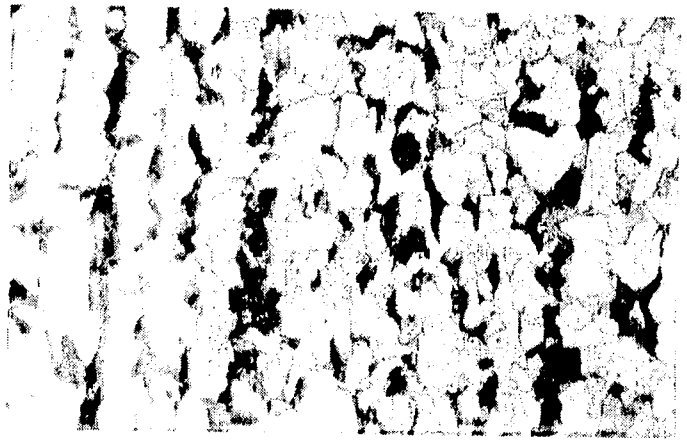
Figure 6E:
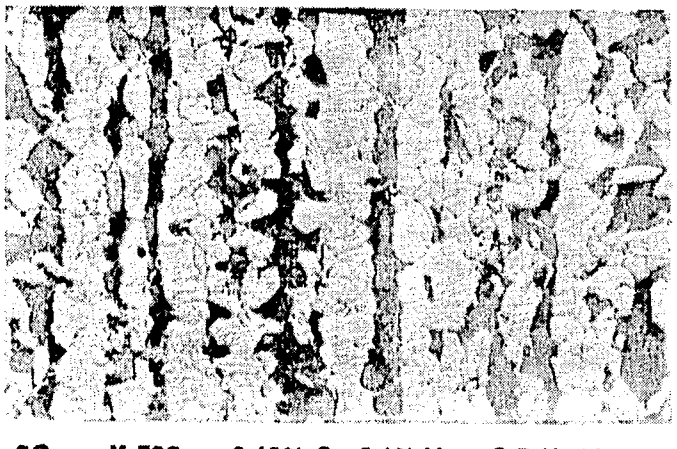
Figure 6B:
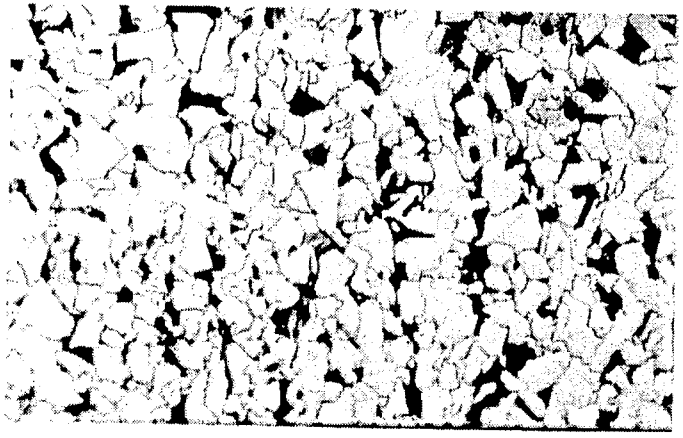
Figure 6D:
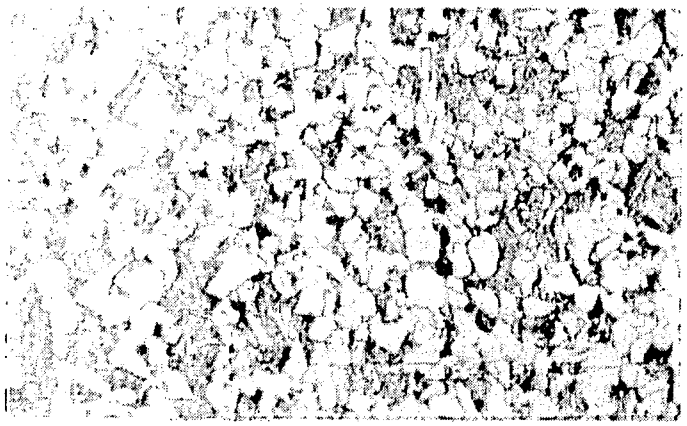
Figure 6F:
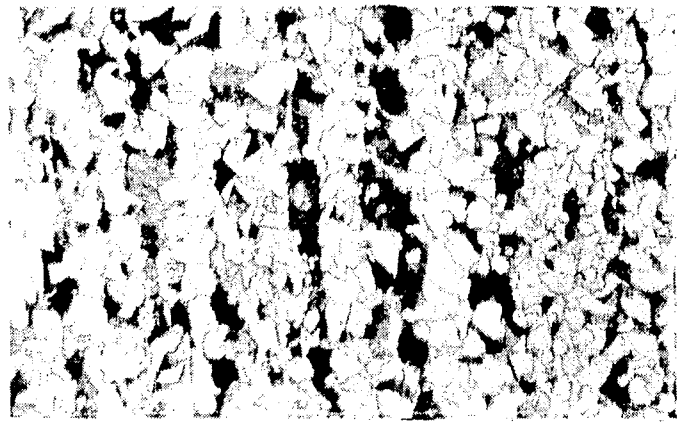
Figure 6H:
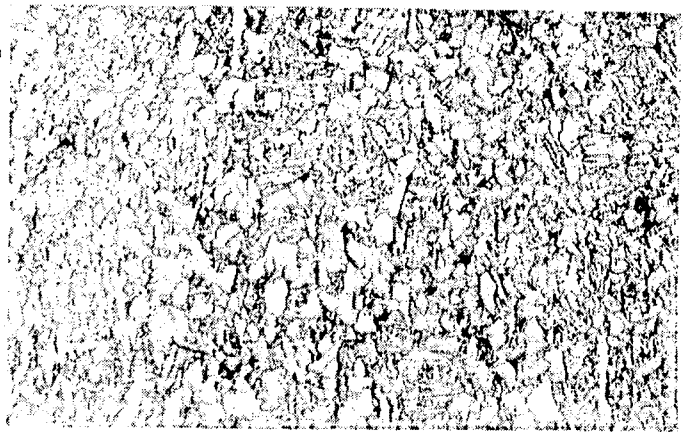

The FIG. 2 graph ends with the extractor pass. FIG. 5, discussed below, deals with the further passes through the stretch reducing mill.

Figure 3A:
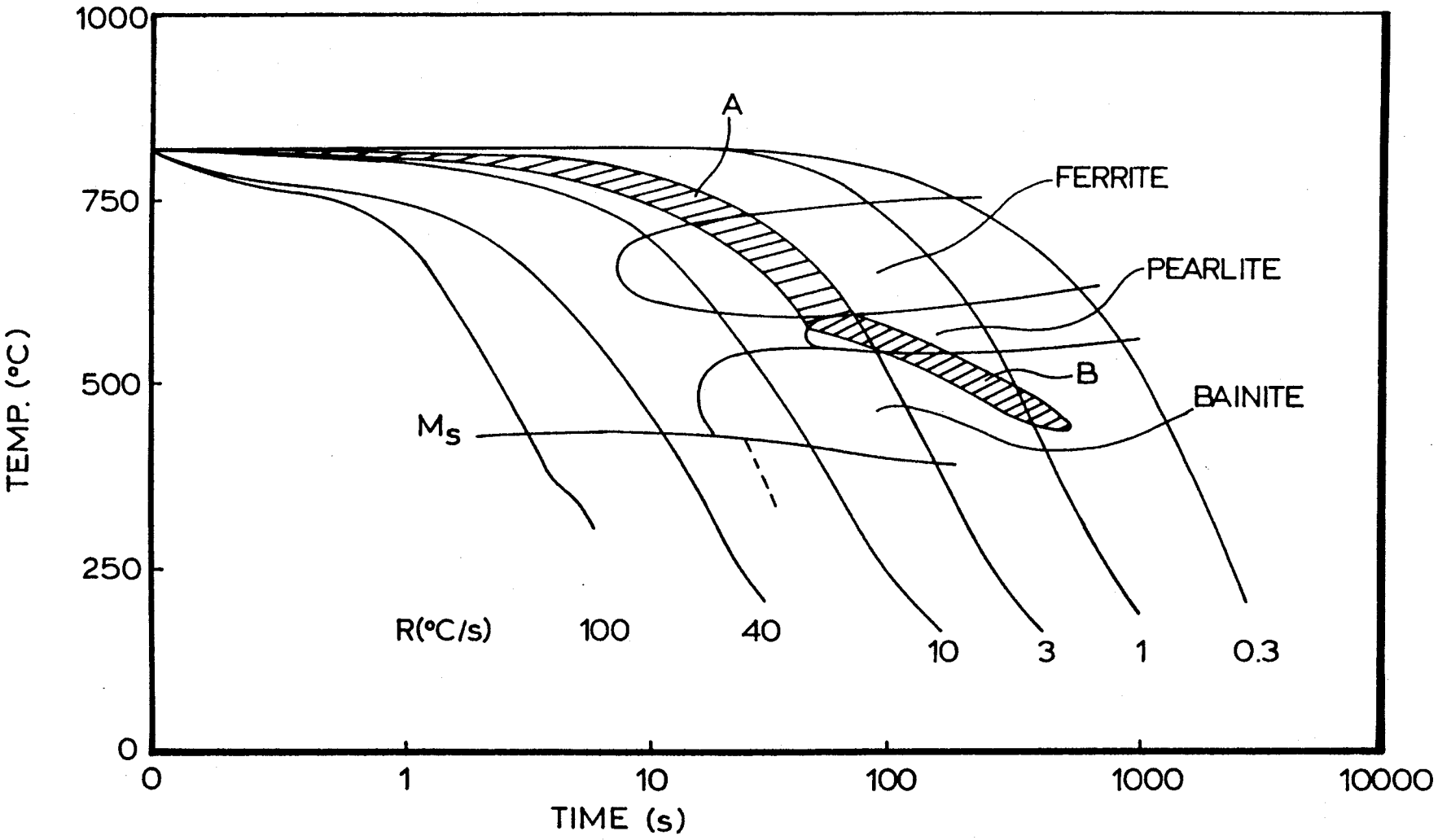
FIGS. 3A and 3B are continuous cooling diagrams for steels made in accordance with the present invention, showing various rates of accelerated cooling.
Figure 3B:
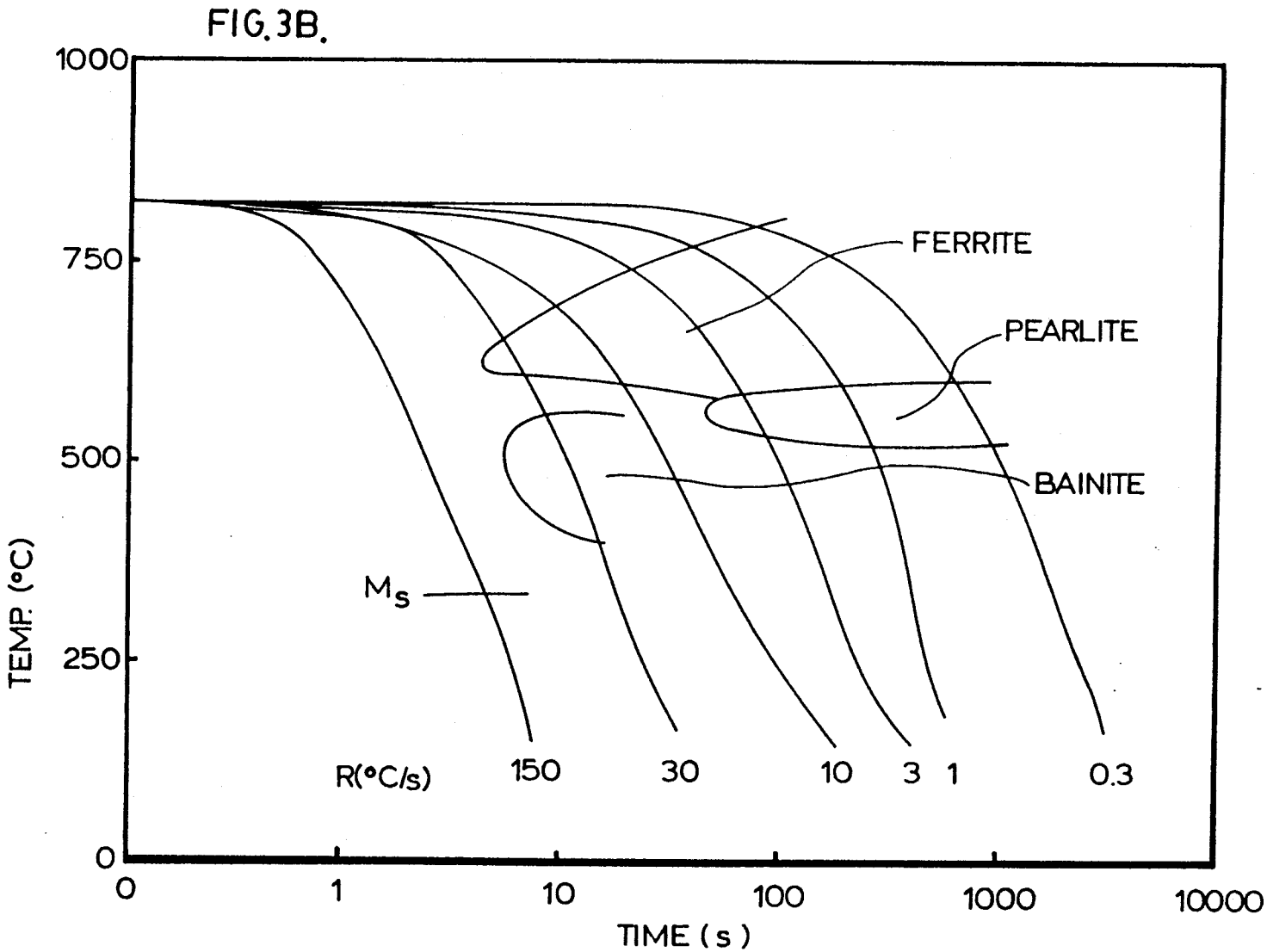

Referring now to FIGS. 3A and 3B, accelerated cooling of the finished tubes through the austenite-to-ferrite transition temperatures also has a helpful grain refining effect. FIG. 3A is a continuous cooling diagram showing the cooling curves for a high carbon steel while FIG. 3B is a continuous cooling diagram showing the cooling curves for a low carbon steel. As shown in cross-hatched area A of FIG. 3A, the preferred cooling rate is between 3° C. per second to 5° C. per second. The exact cooling rate will depend on the diameter of the steel tube and will be selected to maximize the grain refining effect uniformly throughout the thickness of finished tubes without the creation of undesirable bainite or martensite within the samples. If the cooling rate is too slow, then the grain refining effect is not significant. Cooling at too high a rate, however, results in nonuniform grain size refinement, and on the formation of bainite and martensite in the outside portions of the walls of the finished tubes while the interior portions of the wall tend to experience little, if any, grain refining effect. Preferably, the tubes are subjected to accelerated cooling down to about 600° C. at 3°–5° C. per second (as shown in area A) and then air cooled (as shown in area B).

The present invention will be further illustrated by way of the following examples.

EXAMPLE 1

Two steel ingots were prepared from an electric arc furnace heat of the following nominal composition:

| Element | Amount |
|---|---|
| Carbon | 0.10% |
| Manganese | 1.7% |
| Silicon | 0.3% |
| Sulphur | 0.006% |
| Phosphorus | 0.014% |
| Aluminum | 0.013% |
| Titanium | 0.010% |
| Vanadium | 0.095% |
| Nitrogen | 0.017% |
| Iron and Impurities | balance |

A seamless tube simulation was carried out as follows. ¼" diameter×¾" long samples were machined from the ingots. These samples were then placed in a servo-hydraulic computer controlled torsion testing machine, together with a temperature programmed radiant furnace, and subjected to a temperature-time and strain-time schedule simulating the strains and temperatures experienced by a steel billet as it passes through a seamless steel tube rolling mill such as the Algoma No. 2 mill, the temperature-strain-time schedule of which is summarized in FIG. 2. At the end of the schedule, a sample was permitted to cool at about 1° C. per second to duplicate air cooling of a steel tube. A second sample was forced cooled at a rate of 4° C. per second to duplicate the accelerated cooling of a steel tube. From this grain size, structure and hardness were determined.

Further physical properties such as yield strength (LYS), ultimate tensile strength UTS and elastic ratio (LYS/UTS) were determined by rolling the balance of the ingots on an 18"2-Hi fully instrumented pilot mill to 5" long×6" wide×½" thick plates, using temperature-strain-time schedules similar to those determined by the above torsion testing. All accelerated cooling, both during and after rolling, was carried out in a highly controlled and instrumented cooling chamber.

The physical properties of the plate were measured and are summarized as Table 1, in which Sample A was air cooled and Sample B was forced cooled.

TABLE 1

| SAMPLE | % C | % V | Yield LYS (psi) | UTS (psi) | Ultimate Ratio | Size( ) |
|---|---|---|---|---|---|---|
| A(air cooled) | .11 | .095 | 69,800 | 85,200 | .82 | 9.9 |
| B(force cooled) | .11 | .095 | 78,400 | 98,700 | .79 | 4.9 |

EXAMPLE 2

Two ingots were prepared from an electric arc furnace heat of the following nominal composition.

| Element | Amount |
|---|---|
| Carbon | 0.12% |
| Manganese | 1.7% |
| Silicon | 0.36% |
| Sulphur | 0.007% |
| Phosphorus | 0.014% |
| Aluminum | 0.017% |
| Titanium | 0.010% |
| Vanadium | 0.170% |
| Nitrogen | 0.0170% |
| Iron & Impurities | balance |

Two samples, C and D, were formed as in Example 1 and were again subjected to the same temperature-strain-time schedule as in Example 1, sample C being air cooled while sample D was force cooled. The physical properties as well as the grain size for each sample were measured and are summarized in Table 2.

TABLE 2

| SAMPLE | % C | % V | Yield LYS (psi) | UTS (psi) | Ultimate Ratio | Size( ) |
|---|---|---|---|---|---|---|
| C(air cooled) | .13 | .165 | 75,000 | 92,500 | .81 | 9.9 |
| D(force cooled) | .12 | .170 | 92,900 | 108,700 | .86 | 4.2 |

EXAMPLE 3

Two steel ingots were prepared from an electric arc furnace heat of the following nominal composition:

| Element | Amount |
|---|---|
| Carbon | 0.18% |
| Manganese | 1.7% |
| Silicon | 0.32% |
| Sulphur | 0.007% |
| Phosphorus | 0.014% |
| Aluminum | 0.016% |
| Titanium | 0.010% |
| Vanadium | 0.093% |
| Nitrogen | 0.0160% |
| Iron & Impurities | balance |

Two samples, E and F, were formed as in Example 1 and were subjected to the same temperature-strain-time schedule as in Example 1, sample E being air cooled while sample F was force cooled. The physical properties as well as the grain size for each sample were measured and are summarized in Table 3.

TABLE 3

| SAMPLE | % C | % V | Yield LYS (psi) | UTS (psi) | Ultimate Ratio | Size( ) |
|---|---|---|---|---|---|---|
| E(air cooled) | .18 | .093 | 78,000 | 99,200 | .78 | 7.0 |
| F(force cooled) | .18 | .095 | 105,000 | 120,900 | .87 | 5.9 |

EXAMPLE 4

Two ingots were prepared from an electric arc furnace heat of the following nominal composition.

| Element | Amount |
|---|---|
| Carbon | 0.18% |
| Manganese | 1.8% |
| Silicon | 0.36% |
| Sulphur | 0.007% |
| Phosphorus | 0.015% |
| Aluminum | 0.026% |
| Titanium | 0.012% |
| Vanadium | 0.16% |
| Nitrogen | 0.0170% |
| Iron & Impurities | balance |

Two samples, G and H, were formed as in Example 1 and were subjected to the same temperature-strain-time schedule as were samples A and B in Example 1, sample G being air cooled while sample D was forced cooled. The physical properties as well as the grain size were measured for each sample and are summarized in Table 4.

TABLE 4

| SAMPLE | % C | % V | Yield LYS (psi) | UTS (psi) | Ultimate Ratio | Size( ) |
|---|---|---|---|---|---|---|
| G(air cooled) | .19 | .150 | 83,800 | 108,100 | .78 | 5.9 |
| H(force cooled) | .18 | .160 | 114,600 | 132,600 | .87 | 4.2 |

Figure 4:
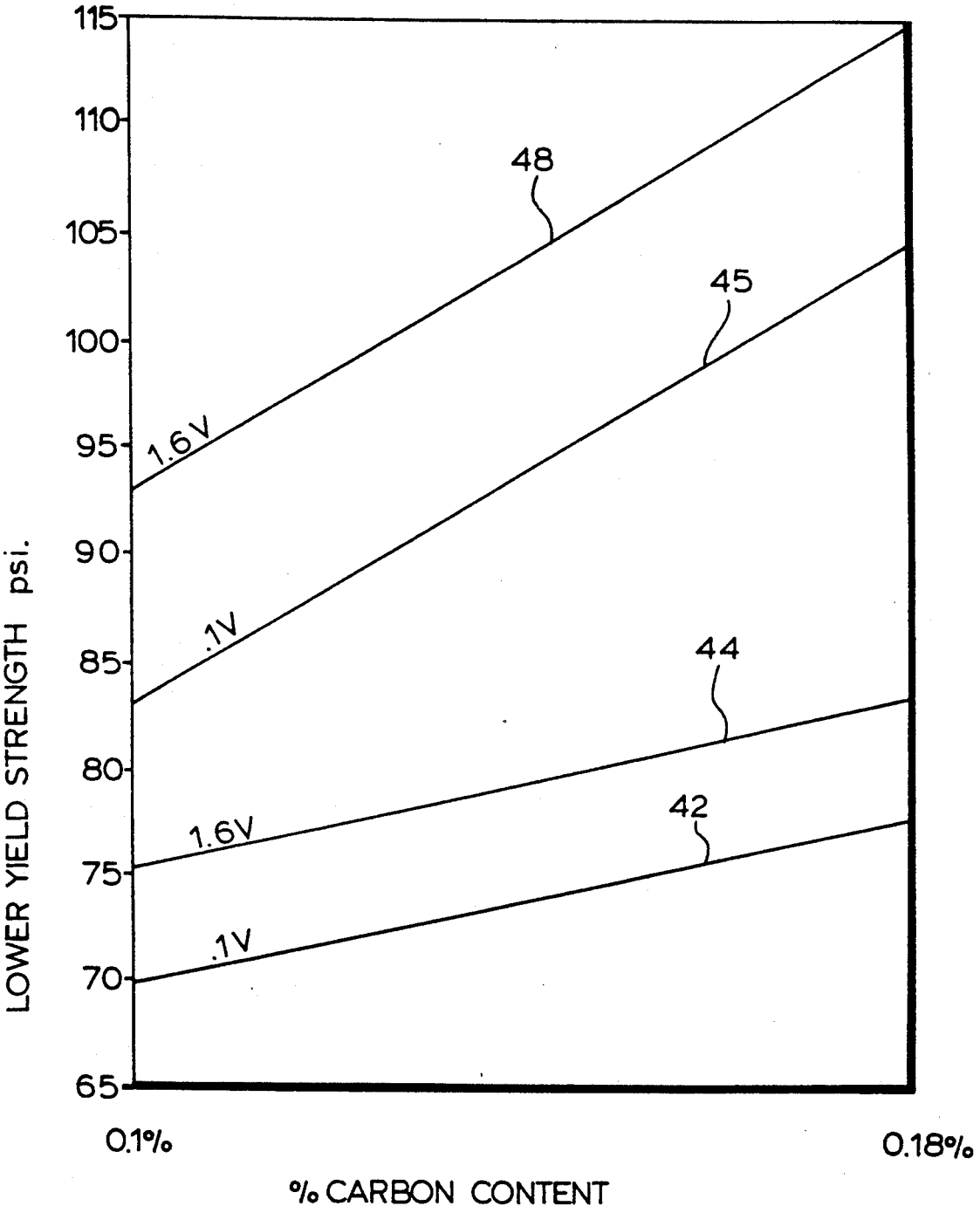
FIG. 4 is a graphical illustration of the yield strength of steels made in accordance with the present invention.

The results of Examples 1 through 4 are summarized in FIG. 4, and in FIGS. 5A through 5H, which are photomicrographs showing the grain structure of Samples A through H, respectively.

Referring now to FIG. 4, the final yield strengths of the steel samples of Examples 1–4 depend on the method of manufacture and the chemistry of the steels. As can be seen from comparing line 42 to line 44 and line 45 to line 48, increasing the vanadium content of the steel tends to increase the final yield strength of the finished product. As disclosed earlier, vanadium is present at room temperature in the form of vanadium nitride and tends to increase the final yield strength of the final product by increasing the amount of precipitation hardening in the steel used. At hot rolling temperatures, it is in solution and acts so as to raise the $T_{nr}$; its presence makes it possible to provoke dynamic recrystallization in the stretch reducing mill and to achieve grain refinement by this means. Therefore, embodiments of the present invention which involve the use of steels having 0.16% vanadium by weight, as in Example 4, will tend to produce end products having yield strengths greater than those end products produced by alternative embodiments of the present invention which utilize lower concentration of vanadium. It is also clear from FIG. 4 that increasing the percentage of carbon within the steel used also increases the final yield strength of the product, by increasing the volume fraction of pearlite. Hence, embodiments of the present invention making use of steel chemistries containing 0.18% carbon by weight, as in Example 4, will produce end products having yield strengths greater than those end products produced by alternative embodiments of the present invention which utilize lower concentrations of carbon. Increasing the percentage of carbon in the steel chemistries has the effect of increasing the volume fraction of pearlite in the final product.

It is believed by the inventors that the high yield strength of the steel tubes made in accordance with the present invention is the result of the combination of a proper balance of Ti, V and N in the subject steel chemistry and the subsequent thermomechanical processing carried out in accordance with the temperature and strain profile of FIG. 2. The inventors believe that prior art methods did not utilize enough nitrogen to ensure that sufficient TiN and VN exist in the finished tube of grain refinement and precipitation strength. Adding at least 150 parts per million nitrogen in the combined form of VN during alloying is one way to ensure that there is sufficient recoverable nitrogen to form TiN and VN in the steel at room temperature.

FIG. 4 also illustrates the effect of accelerated cooling on the yield strength of the final product. In some embodiments of the present invention, final products having yield strengths in excess of 110,000 psi can be produced as a result of combining high levels of vanadium and high levels of carbon with accelerated cooling of the final product within a preferred range of cooling rates.

FIG. 5 illustrates the effect of different selections of entry temperature on a series of stretch reducing mill reductions or passes, relative to the continuous-cooling precipitation conditions applicable. Temperature in degrees Celsius is plotted against the logarithm of elapsed time of the reduction schedule, the various passe being identified by vertical dotted lines with the pass number superimposed at the top of the vertical line. In order to avoid crowding the drawing, only the even numbered passes are illustrated.

Typical reduction schedule curves for three different entry temperatures as the steel shell enters the stretch reducing mill are shown. The entry temperature is stated within a rectangular box appended to the right hand end of each of the curves. The interpass time interval is short—typically half a second or less.

Also shown in FIG. 5 is the continuous-cooling precipitation curve for vanadium nitride, abbreviated on the graph as "CCP for VN". This curve has a typical distinctive nose, which is shown as intersecting the 850° C. entry temperature reduction schedule curve at about pass 13.

For conventional controlled rolling schedules for making seamless tubing, it is desired that the reduction schedule curve selected should intersect the nose of the applicable CCP curve. This ensures that static precipitation will occur at the earliest possible moment in the rolling schedule, which is desirable for conventional controlled rolling of steel tubing.

However, according to the present invention, static precipitation is to be avoided—what is wanted is dynamic recrystallization in the absence of static precipitation. Thus a reduction schedule should be chosen that avoids the nose of the CCP curve. Both the 910° C. entry temperature curve and the 1000° C. entry temperature curve avoid the nose of the CCP curve for the vanadium nitride in the steel, and consequently either would be satisfactory from the point of view of avoidance of static precipitation. On the other hand, dynamic recrystallization would be prevented at the point that the 850° C. entry temperature curve reaches the 13th pass, and consequently that curve would represent an unsuitable choice for the practice of the present invention.

Consequently, if the reduction schedule is suitably chosen to avoid the CCP curve nose, dynamic recrystallization will occur. The titanium in the steel is believed to prevent undue growth of grains during recrystallization and consequently the beneficial results previously mentioned should be obtainable.

Note that while precipitation strengthening due to precipitation of vanadium nitride is one of the benefits of practising this invention, such precipitation according to the invention occurs only during the ferrite phase. Precipitation during the austenite phase is to be avoided, since it would interfere with dynamic recrystallization.

FIGS. 6A through 6H represent photomicrographs taken from samples A through H of Examples 1 through 4, respectively, which illustrate the grain refining effects of the various embodiments of the present invention. The G.D.N. (grain diameter number, as determined by the intercept method) is given for each sample. As can be seen from these photomicrographs, force cooling of the samples has a significant grain refining effect.

Variants of the described method may be practised on the Algoma No. 2 seamless tube mill, which has the temperature-strain-time schedule summarized in FIG. 2, with the addition of optional cooling means 22 and/or optional accelerated cooling means as necessary. However, the method may also be carried out on other retained mandrel seamless tube mills having similar temperature-strain-time profiles.

While the present invention has been described and illustrated with respect to the preferred examples, it will be appreciated that variations may be made without departing from the subject invention, the scope of which is defined in the appended claims.

What is claimed is:

1. A fully killed steel having a high yield strength for use in the production of seamless steel tubes comprising, by weight, about 0.1% to 0.18% carbon, about 1.0% to 2.0% manganese, about 0.10% to 0.16% vanadium, about 0.008% to 0.012% titanium and between about 150 p.p.m. to 220 p.p.m. nitrogen, the balance comprising iron and incidental impurities, said steel having an essentially uniform fine grain of an essentially ferritic grain structure with an average grain size finer than 10 micrometers, said steel having yield strengths of greater than 70,000 psi.

2. A steel as defined in claim 1, comprising by weight about 0.16% vanadium.

3. A steel as defined in claim 1, wherein the vanadium, titanium and nitrogen are present in the killed steel predominantly in the form of vanadium nitride and titanium nitride.

4. A steel as defined in claim 1, 2 or 3, comprising 0.03% to 0.05% aluminum by weight.

5. A seamless tube made from a fully killed steel having a high yield strength comprising, by weight, about 0.1% to 0.18% carbon, about 1.0% to 2.0% manganese, about 0.10% to 0.16% vanadium, about 0.008% to 0.012% titanium and between about 150 p.p.m. to 220 p.p.m. nitrogen, the balance comprising iron and incidental impurities, said steel having an essentially uniform fine grain of an essentially ferritic grain structure with an average grain size finer than 10 micrometers, said steel having yield strengths of greater than 70,000 psi.

6. A steel tube as defined in claim 5, wherein the steel comprises about 0.16% vanadium by weight.

7. A steel tube as defined in claim 5, wherein the vanadium, titanium and nitrogen are present in the killed steel predominantly in the form of vanadium nitride and titanium nitride.

8. A steel tube as defined in claim 5, 6 or 7, comprising 0.03% to 0.05% aluminum by weight.

9. A seamless tube made from a billet by passing a hot billet of steel through a piercing mill located downstream of the reheating furnace, wherein the billet is formed into a steel shell; elongating the steel shell within a mandrel mill located downstream of the piercing mill; and reducing the diameter of the elongated shell by a series of reductions in a stretch reducing mill located downstream of the mandrel mill to form a tube of desired diameter; characterized in that a) the steel comprises, by weight, about 0.10% to 0.18% carbon, about 1.0% to 2.0% manganese, about 0.10% to 0.16% vanadium, about 0.008% to 0.012% titanium and about 150 p.p.m. to 220 p.p.m. nitrogen, the balance comprising iron and incidental impurities; and b) in the stretch reducing mill, strains are applied to the shell to form the tube according to a reduction schedule selected to avoid the onset of precipitation of vanadium nitride during the austenite phase, while the temperature of the steel is maintained above the $A_{r3}$ temperature but below the $T_{nr}$ temperature, thereby causing accumulated strain in the stretch-reduced tube;

whereby the yield strength of the steel tube is enhanced by (i) dynamic recrystallization in the absence of strain-induced precipitation;

(ii) grain refinement of austenite that is transformed upon further cooling to retained grain refinement of ferrite in the shell; and (iii) precipitation strengthening by precipitation of vanadium nitride during the ferrite phase.

10. A steel tube as defined in claim 9, wherein the steel comprises by weight about 0.16% vanadium.

11. A steel tube as defined in claim 9, wherein the vanadium, titanium and nitrogen are present in the killed steel predominantly in the form of vanadium nitride and titanium nitride.

12. A steel tube as defined in claim 11, comprising 0.03% to 0.05% aluminum by weight.

* * * * *

UNITED STATES PATENT AND TRADEMARK OFFICE

CERTIFICATE OF CORRECTION

PATENT NO. : 5,226,978

DATED : July 13, 1993

INVENTOR(S) : Hunt et al.

It is certified that error appears in the above-identified patent and that said Letters Patent is hereby corrected as shown below:

In column 3, line 21, "above" should read -- below --.

In column 10, line 46, delete "within a rectangular box appended".

On drawing sheet

In Figure 4, sheet 5 of 8 of the drawings, in the lines indicated by reference numerals 44 and 48, "1.6V" should read -- .16V --.

Signed and Sealed this

Sixth Day of September, 1994

Bruce Lehman

*Attest:*

BRUCE LEHMAN

*Attesting Officer*

*Commissioner of Patents and Trademarks*